United States Patent [19]

Bloom et al.

[11] 4,367,249

[45] Jan. 4, 1983

[54] PROCESS AND APPARATUS FOR CONTROLLING DISTRIBUTING AND MONITORING LIQUIDS

[75] Inventors: Harold T. Bloom; Richard E. St. Pierre, both of Charlotte, N.C.

[73] Assignee: Celanese Corporation, New York, N.Y.

[21] Appl. No.: 251,417

[22] Filed: Apr. 6, 1981

Related U.S. Application Data

[63] Continuation of Ser. No. 141,016, Apr. 17, 1980, abandoned.

[51] Int. Cl.[3] ..... B05D 1/02

[52] U.S. Cl. ..... 427/345; 427/421; 427/424; 118/300; 118/325; 118/326

[58] Field of Search ..... 118/325, 300, 326; 427/345, 421, 424, 428; 239/220

[56] References Cited

U.S. PATENT DOCUMENTS

| | | | |
|---|---|---|---|
| T874,005 | 5/1970 | Estersevitz | 118/7 |
| 1,462,363 | 7/1923 | Christensen | 427/421 |
| 2,403,018 | 7/1946 | Oglesby | 118/325 |
| 2,676,565 | 4/1954 | McDermott | 118/325 |
| 2,965,516 | 7/1960 | Wagner | 118/325 |
| 3,365,346 | 1/1968 | Fritz et al. | 156/152 |
| 3,387,992 | 6/1968 | Arthur et al. | 118/325 |
| 4,132,189 | 1/1979 | Greve et al. | 118/DIG. 6 |

OTHER PUBLICATIONS

Acetate Tow for Cigarette Filters, Indexed 39465, Kodak, Technical Bulletin 1-77; 1/77.

*Primary Examiner*—Shrive P. Beck
*Attorney, Agent, or Firm*—Robert J. Blanke

[57] ABSTRACT

A process and apparatus for controlled application of a liquid to a variable width filamentary band such as a cigarette tow band. Liquid is fed at a constant rate by one or more positive displacement pumps to an applicator device which may be a disc type or a brush type applicator device. Any liquid which is not picked up from the applicator device by the tow band is returned by means of channels located in a housing member directly to the applicator device whereby variations in the width of the tow band do not substantially change tow liquid pick-up from a preselected weight level.

7 Claims, 7 Drawing Figures

PROCESS AND APPARATUS FOR CONTROLLING DISTRIBUTING AND MONITORING LIQUIDS

This is a continuation of application Ser. No. 141,016 filed Apr. 17, 1980 now abandoned.

This invention relates to the treatment of filamentary and other fibrous materials in order to impact certain desired or selected properties thereto and is more particularly concerned with the production of filter-rod stock for use in the manufacture of filter-tip cigarettes.

Filters for cigarettes are commonly formed from a multiplicity of filaments arranged in essentially longitudinal alignment with substantially all such filaments extending continuously from one end of the filter to the other. In the production of such a filter, a tow or bundle of upward of several thousand substantially longitudinally aligned continuous filaments, preferably already suitably crimped, is passed through one or more devices that serve essentially to open up the advancing tow. The result is that the tow assumes the appearance more or less of a continuous band or web of varyingly increased width. The many different arrangements that have been proposed to accomplish this objective range from those which ordinarily do little more than flatten, widen, and/or smooth out the tow to those which also separate the filaments as necessary to bring the same more nearly into longitudinal alignment and/or to effect deregistration of the crimp in adjacent filaments.

The open tow may be treated with a selective additive material in order to impart a desired property or effect thereto. Such additive material may be in liquid form. Illustrative types of liquid-form additive materials comprise plasticizers such as glycerol triacetate (triacetin) and triethyl citrate, lubricants such as light mineral oil and diethylene glycol, and antistatic agents such as mixtures of magnesium chloride in water and diethylene glycol.

The resulting opened, spread and liquid treated tow may then be passed without any further treatment essentially directly to the garniture of a filter-rod maker, wherein it is condensed to provide a continuous filter-rod stock having a cross-sectional area corresponding to that of the filter-tipped cigarettes to be produced. Customarily, the desired filter rods are obtained by appropriately cutting or severing such continuous filter rod stock as it issues from the garniture.

A number of procedures is available for applying a liquid form material to the advancing tow. A liquid-form treating material such as a plasticizer or other filament-bonding agent, for example, is customarily discharged through appropriately arranged and designed nozzles, wicks or spray-forming devices such as rotary brushes such as are disclosed in U.S. Defensive Publication No. T 874,005 published May 19, 1970 or rotary discs such as are disclosed in U.S. Pat. Nos. 3,387,992 and 3,818,863. However, all of these prior art applications pass excess liquid; that is to say, liquid not picked up by the tow to a holding device or tank and therefore there is no mechanism to compensate for unequal liquid pick-up.

Regardless of the method employed for applying the liquid form material to the tow band, it is necessary to monitor and control the amount of liquid form material applied to the tow. The most common method of the prior art for determining the amount of liquid form added to the tow band is the so-called wet/dry weight method. In this system, a wet rod sample is taken and a weight measurement made and then liquid application is discontinued. When sufficient time has elasped to assure there is no liquid application, dry rod samples are taken and a dry weight measurement is made. This method of monitoring is, of course, a discontinous method and is inherently wasteful. An improved prior art system for determining liquid add-on is a metering system based on the use of a pneumatically controlled, valveless, positive-displacement pump. This pump supplies plasticizer to the plasticizer-application booth at a rate that is equal to the rate at which the plasticizer is applied to the tow. A pneumatic system governs the pump speed and is activated by a float valve in the applicator booth. When the depth of plasticiser in the booth decreases from a nominal, predetermined level, the float valve closes, creating a pressure differential across a diaphragm. The diaphragm then opens a valve that controls the supply of air to an air-driven motor that drives the pump. The pump speed relates to the position of the float valve and is proportional to deviations in the depth of the plasticizer in the booth. The pump is fitted with an optical sensor that detects the rotation of the pump. As the pump rotates, a series of electrical impulses is produced. The frequency of these impulses is proportional to the rate at which the pump rotates, and therefore to the flow rate of the plasticizer. Since the pump has a positive displacement, each impulse can be equated to a known quantity of plasticizer, for example, in mg/pulse.

In theory, if the depth of plasticizer is maintained constant, the amount of plasticizer pumped to the applicator booth can be assumed to equal the amount applied to the tow during any particular time interval. The positive-displacement pump is then used to establish the amount of plasticizer that flows into the system over a period of time. With this information alone, an instrument can be provided that will display a reading of the amount of plasticizer flowing onto the tow, for example, in mg/min.

As previously noted in all of the prior art liquid applicator processes and apparatus for the treatment of tow, liquid which is not applied to the tow is returned to a holding device and must be measured in order to determine the liquid add-on. The disadvantages of these monitoring methods include the probability of untreated cigarette filter rods entering production, loss of production itself, as well as waste. Moreover, none of the prior art processes and apparatus have a variable control for the amount of liquid applied to the tow; that is to say, variations in tow band width will cause corresponding variations in liquid pick-up for which there is no compensation in prior art processes and apparatus.

It is therefore an object of this invention to provide a process for the preparation of cigarette filter rods wherein liquid add-on is constant in spite of tow band width variation.

It is another object of this invention to provide a liquid form add-on apparatus for the treatment of continuous filament tow in the preparation of cigarette filter rods wherein only one liquid flow line need be monitored.

It has been discovered that the aforementioned objectives can be achieved in a process for controlled application of a liquid to a filamentary material by feeding liquid at a constant rate to an applicator device suitable for applying liquid to a running band of filamentary material and causing any liquid not picked up by the tow band to be returned directly to the applicator device. Preferably the liquid is fed at a constant rate by a positive displacement pump and the liquid applicator device is a rotatable brush or a rotatable disc. The apparatus of the instant invention employs a housing provided with means for draining any liquid not returned by said filamentary material back to the applicator means.

A better understanding of the invention may be had from a discussion of the drawings wherein.

Figure 1:
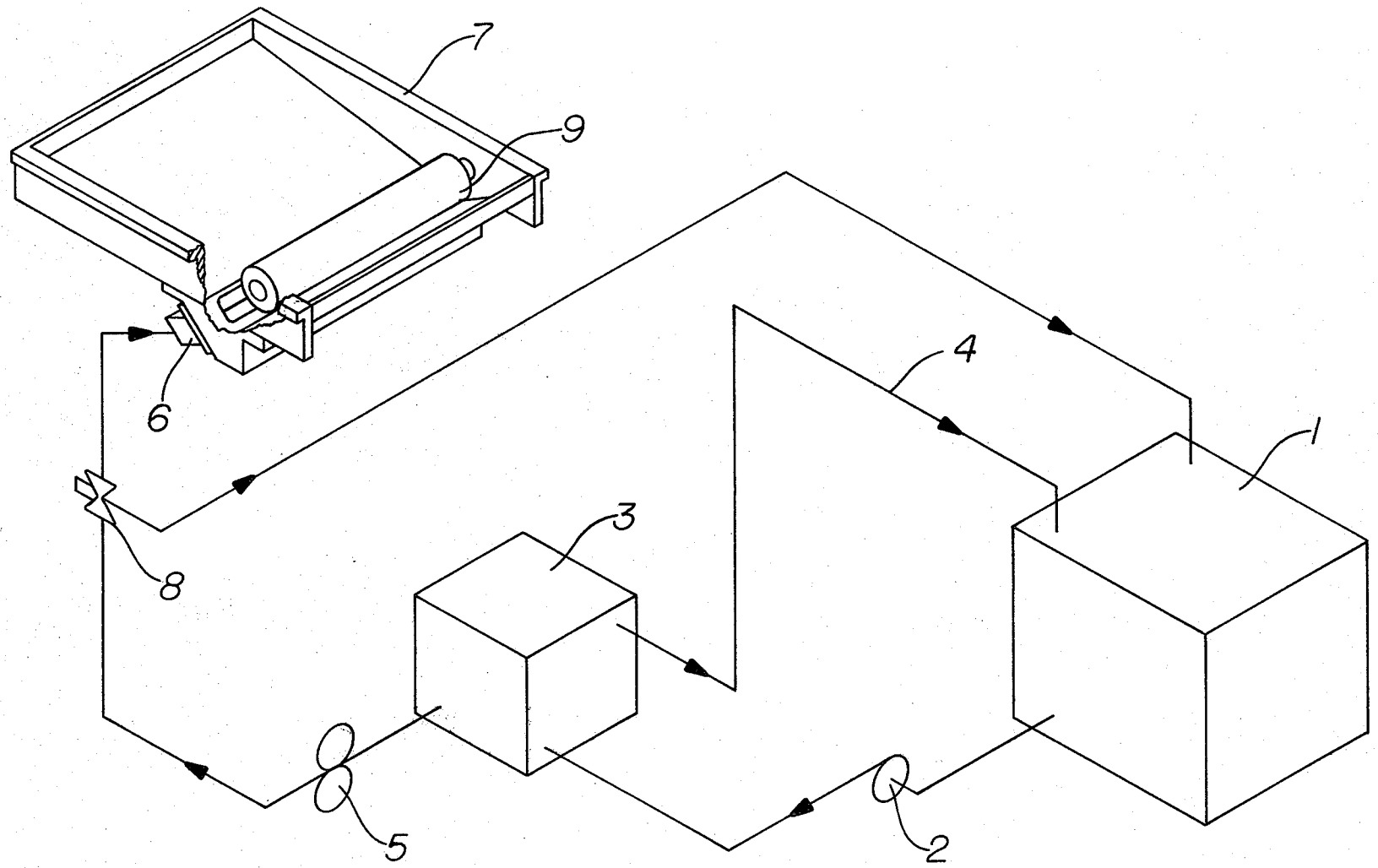
FIG. 1 is a schematic flow diagram of the controlled fluid applicator of this invention suitable for use with a brush type liquid applicator.

Turning to FIG. 1 of the drawings, liquid from a tank member 1 is pumped by means of a centrifugal pump 2 to a pump supply reservoir 3, pump supply resevoir being maintained at a constant level by means of an overflow pipe 4 which feeds excess liquid back to plasticizer tank 1. A positive displacement pump 5 then feeds liquid from the constant pump supply reservoir to the delivery manifold 6 of the liquid applicator device 7, delivery manifold 6 supplying liquid to brush member 9 of liquid applicator device 7. It should be understood that a single positive displacement pump or any plurality of positive displacement pumps which are preferably gear pumps may also be employed for purposes of this invention. By metering plasticizer into the chamber with a gear pump, the revolutions per minute of the pump provides the flow information required. A three-way valve 8 is positioned intermediate gear pumps 5 and delivery manifold 6 in order that liquid feed to the delivery manifold may be diverted back to the plasticizer tank in the event of a discontinuation of feed of material to the applicator chamber 7.

Figure 2:
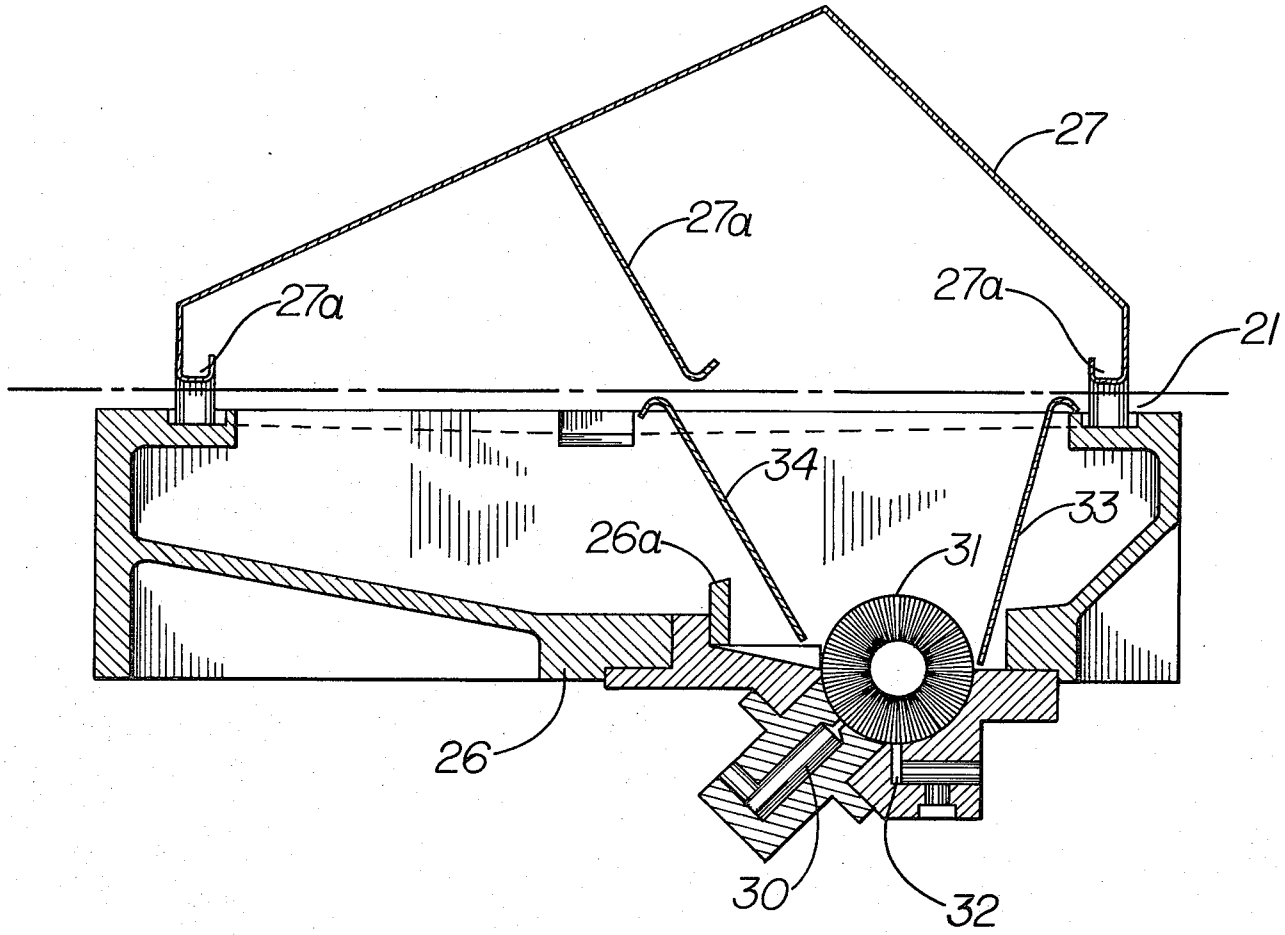
FIG. 2 is a cross sectional view of a brush type liquid applicator suitable for use in this invention.
Figure 3:
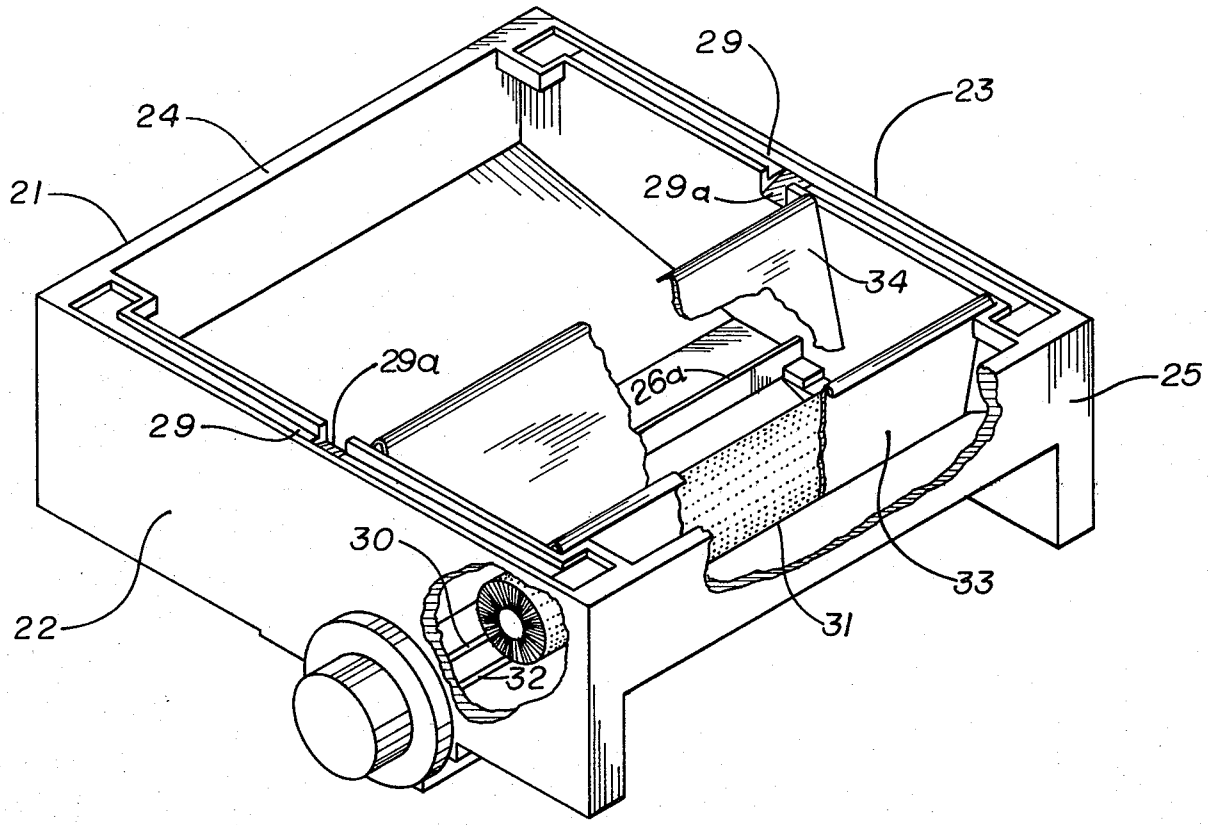
FIG. 3 is a projected view of the bottom portion of the brush type liquid applicator of FIG. 2 of the drawings.

As can be seen in FIGS. 2 and 3 of the drawings, the brush type applicator suitable for use in conjunction with this invention employs a housing or cabinet 21 made of any suitable material and having detachable top and bottom spections. Preferably the bottom portion of the housing 21 consists of side walls 22 and 23, front and rear walls 24 and 25 respectively, and a floor 26. The housing floor 26 extends from the lowermost edges of the side walls 22 and 23 at a relatively gentle downward slope. Positioned near the lowermost point of floor member 26 is delivery manifold member 30, delivery manifold member 30 being positioned between drainback dam **26*a* and brush member 31, the peripheral portion of brush member 31 actually contacting delivery manifold member 30. In order to facilitate drainage and cleaning operations, a drain slot 32 is positioned through housing floor member 26 immediately beneath brush member 31. The ceiling 27 of the housing 21 is closed and consists of a pair of sections extending toward one another at an incline steep slope from the uppermost edges of the side walls. In operation, a constant flow of liquid is continuously supplied through the elongated slot in delivery manifold 30, liquid being picked up by brush member 31 and deposited on tow passing through housing member 31. Baffle members 33 and 34 are positioned on either side of brush member 31 to insure that liquid projected by brush member 31 is properly directed. Any liquid not picked up by the tow due to liquid by pass or variations in tow width is caused by the design of chamber member 21 to be returned to brush member 31 and then recycled by the brush member 31 to the advancing tow line. More specifically, liquid not applied to the tow band collects from the ceiling 27 of the housing 21 and flows downwardly into the channel sections of baffle members 27*a*. Liquid then flows from baffle members 27*a* into side channels 29 and thence into drainback gutter 29*a*. Liquid continues to flow down sidewalls 22 and 23 and collects in drainback dam 26*a*. The drain-back dam 26*a* distributes liquid uniformly back to brush member 31. Drain-back dam member 26*a*** is also useful in facilitating cleaning of the apparatus.

Figure 4:
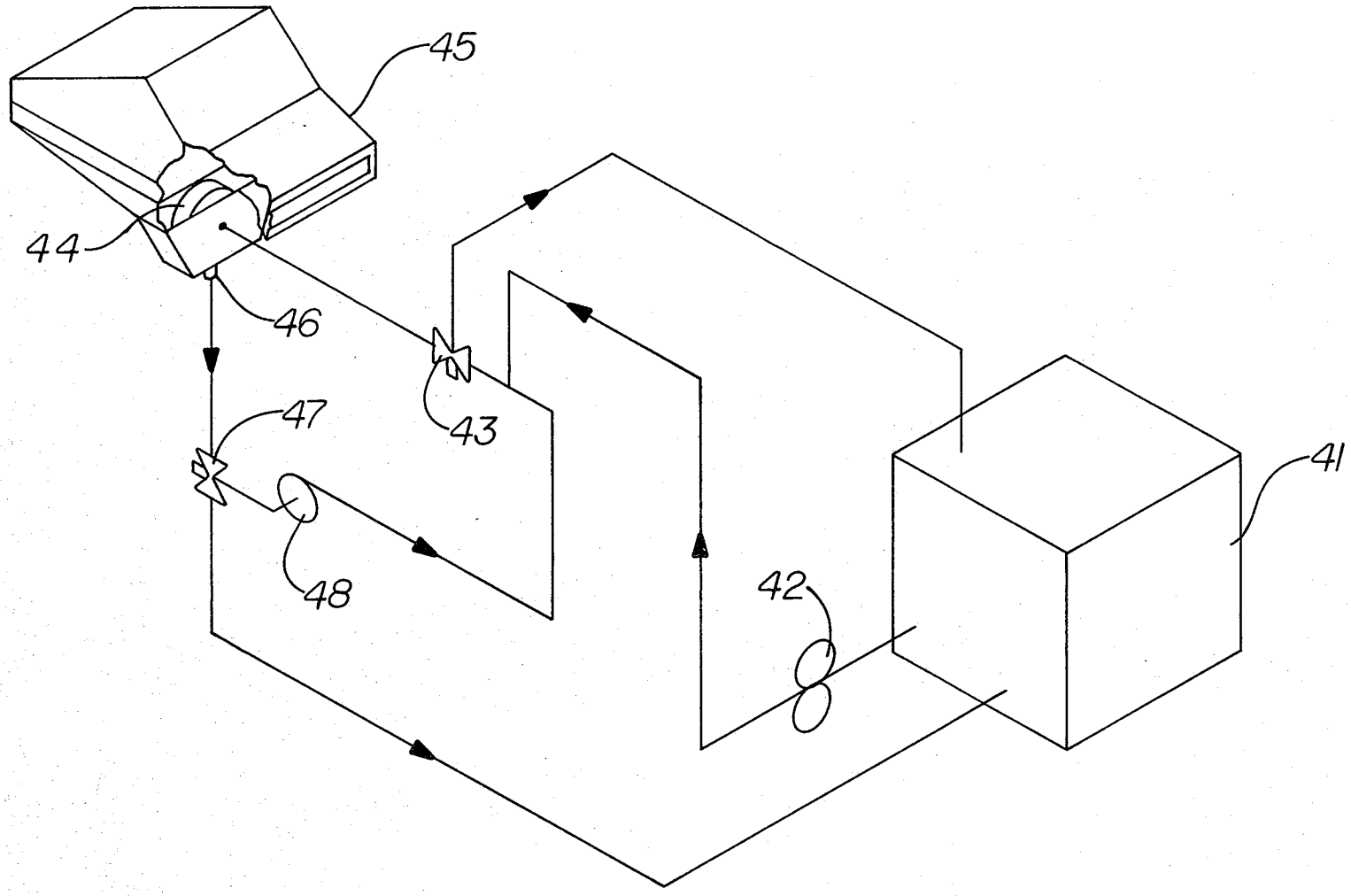
FIG. 4 is a schematic flow diagram of the controlled fluid applicator of this invention suitable for use with a disc type liquid applicator.

The monitored fluid applicator of this invention is also suitable for use in conjunction with disc-type liquid application. A better understanding of this applicator may be had from FIGS. 4 through 6 of the drawings:

Turning to FIG. 4 of the drawings, which is a flow sheet, liquid from a tank member 41 is pumped by means of pump member 42 through a three-way solenoid valve 43 into the center of a rotating disc applicator 44 which is positioned beneath a tow band (not illustrated) passing through applicator chamber 45. Liquid distributed by disc member 44 and not absorbed by the tow, flows to the bottom of chamber member 45 which is equipped with a drain 46 and flows to a three-way solenoid valve 47 which directs liquid flow to a centrifugal pump 48. Pump member 48 in turn directs the flow of liquid back to solenoid valve 43 which in turn directs the liquid back into disc member 44. Equilibrium is achieved by the pump and valve arrangement of this invention and the liquid add-on level is controlled and equal to the pump member 42. When dry runs are desired, that is to say when it is desired to manufacture rods without any liquid addition, plasticizer is pumped from tank member 41 by positive displacement pump member 42 to solenoid valve member 43. Solenoid valve member 43 in turn directs liquid back to tank member 41. In addition, liquid is pumped from tank member 41 through solenoid valve member 47 by centrifugal pump member 48. Liquid from pump member 48 is directed to solenoid valve member 43 and in turn flows back to tank member 41, thereby maintaining flow through centrifugal pump member 48 so as to prevent pump member 48 from running dry. It should be understood, however, that centrifugal pump member 48 may be replaced with other pump members such as for instance vane pumps, lob-type pumps, or other semi-positive displacement pumps.

Figure 5:
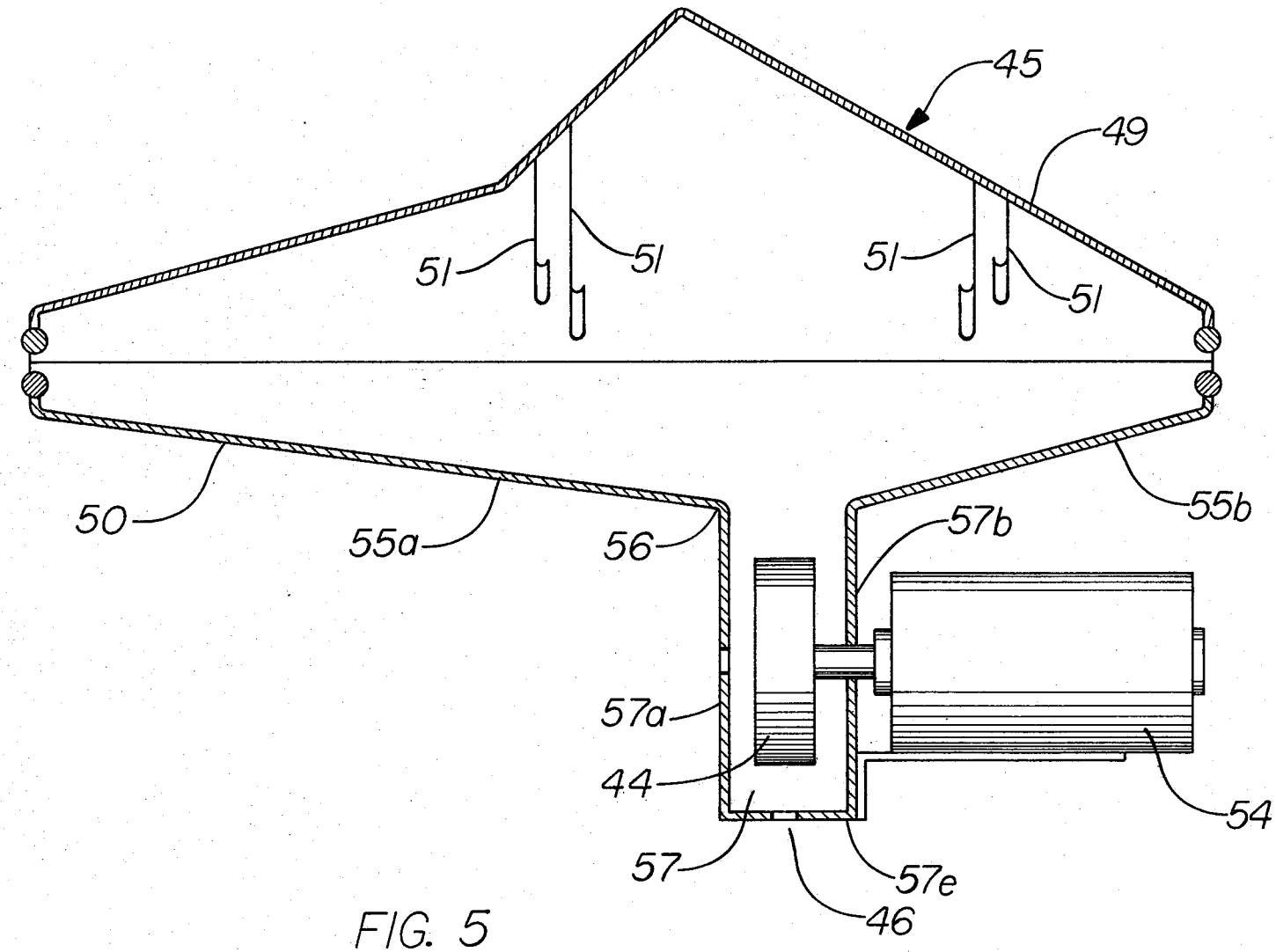
FIG. 5 is a cross sectional view of a disc type liquid applicator suitable for use in this invention.
Figure 6:
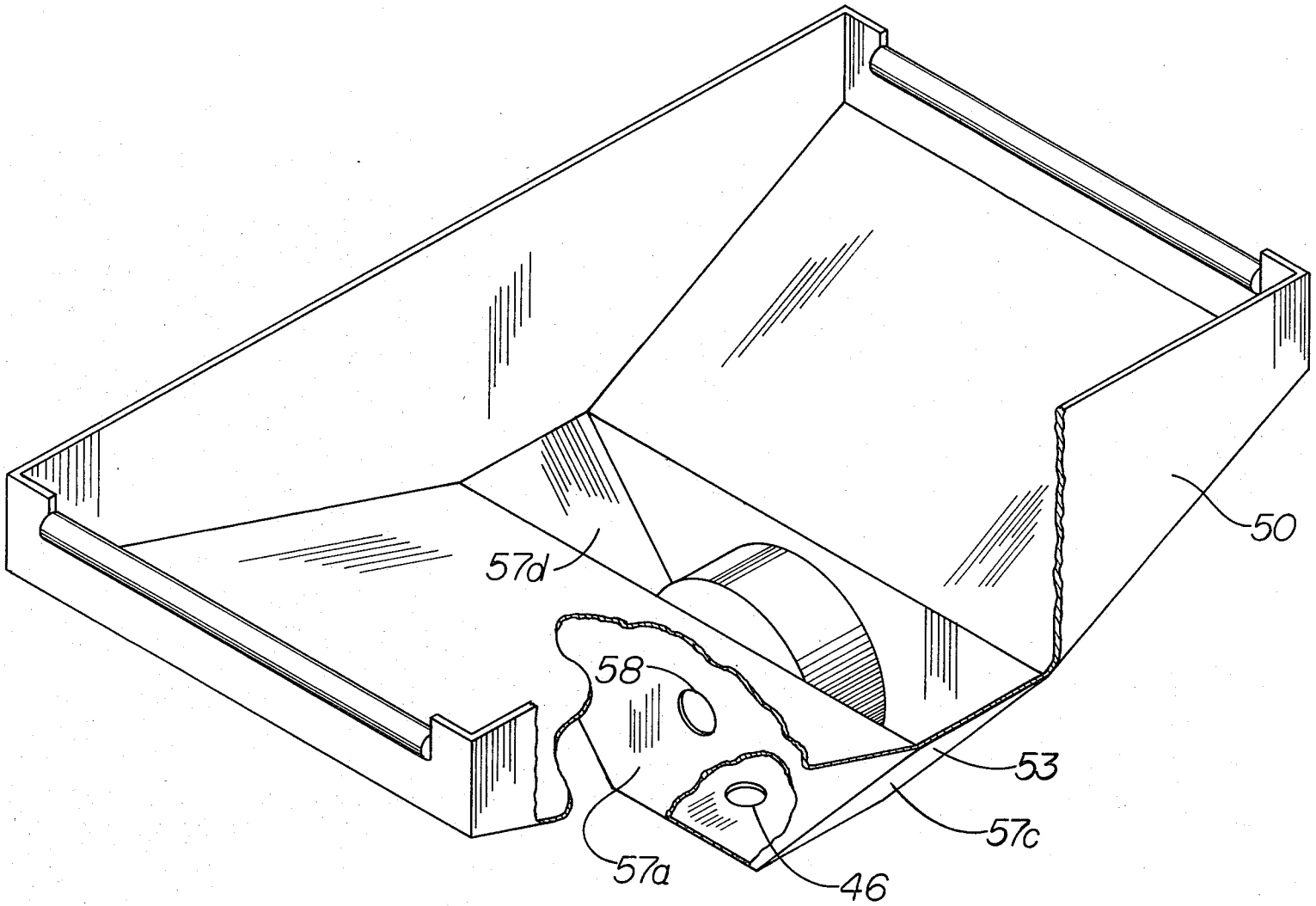
FIG. 6 is a projected view of the bottom portion of the disc type liquid applicator of FIG. 5 of the drawings.

A better understanding of the mechanism of the disc-type plasticizer applicator may be had from a discussion of FIGS. 5 and 6. As can be seen in FIG. 5, housing member 45 consists of an upper housing section 49 and an lower housing section 50, upper housing member 49 being suitably baffled for recycling of liquid not retained by the tow. More specifically, liquid not retained by the tow is directed by baffle members 51 to the side walls (not illustrated) of chamber member 45, chamber member 45 having flat and substantially horizontal side walls covered by a peaked roof, liquid flowing from baffle member 51 down the side walls of chamber 45 into drain 46 positioned at the bottom of the lower section 50 of chamber member 45. The geometry of the lower section 50 of chamber member 45 is such that the downward flow of liquid to drain member 46 is assured.

The lower section 50 of chamber member 45 consists of a pair of floor sections 55*a* and 55*b* extending toward one another at a relatively gentle downward slope and terminating at a predetermined distance from one another essentially medially of the lower section 50, thereby leaving an elongated rectangular opening 56 extending entirely across the housing floor. Arranged below the opening 56 is a well 57 defined by two vertical, trapezoidal side plates 57*a* and 57*b* depending downwardly from the facing edges of floor sections 55*a* and 55*b*, two slanted end plates 57*c* and 57*d* secured to the downwardly converging edges of the plates 57*a* and 57*b*, and a horizontal bottom plate 57*e* secured to the lowermost edges of the plates 57*a* to 57*d*.

Within the well 57 of lower section 50, a liquid spraying disc 44 is arranged for rotation in a plane which is substantially parallel to and centered between the well side plates 57*a* and 57*b*. The disc 44 is essentially shaped in the manner of a narrow mouth cup-like receptacle of the type such as is disclosed in U.S. Pat. No. 3,387,992.

Disc member 44 is driven, preferably by a motor 54 located external of the well 57. It should be understood that while a single disc member 44 has been illustrated, that a plurality of discs may also be employed in either a side-by-side or back-to-back arrangement. Liquid is introduced to the disc through port member 58 located preferably in axial alignment with the axis of rotation of disc member 44. As previously noted, the total number of discs may vary but, in any event, should be sufficient to ensure that a steady state of recycled liquid is achieved; that is to say, when band width is reduced resulting in a higher recycle of liquid, a sufficient number of recycled discs should be present to quickly restore steady-state conditions. Preferably, the disc-type or brush type applicator can be equipped with pressure or flow sensing switches to prevent overfilling of the plasticizer tank should the pump drive fail or should the pump drives fail resulting in production of untreated rods, the plasticizer flow rate can be determined by means of an rpm detector, employed in conjunction with positive displacement pump 42. It so desired, information from the rpm detector may be processed through a suitable conversion device which in turn activates a digital display of the liquid flow rate. It should be understood that suitable filtering and particle trapping systems may also be incorporated in the apparatus of this invention.

The principle of the present invention will be more fully understood from the following examples wherein data has been generated employing the brush-type applicator system. It should be understood, however, that comparable results will also be obtained when the disc type applicator of this invention is employed.

EXAMPLE

A cigarette tow composed of 4.0 DPF cellulose acetate filaments having a total denier of 39,000 is passed through an applicator chamber constructed substantially in the form as illustrated in FIGS. 2 and 3 of the drawings. The tow is processed at a linear speed of 400 meters per minute. The brush member of the applicator device is rotated at a speed of 3400 revolutions per minute. Triacetin liquid plasticizer is pumped to the brush at a rate of 220 grams per minute.

As a control, a brush applicator system 54-FA-1 manufactured by Hauni-Werke Korber & Co. KG of Hamburg, West Germany which employs a holding tank or booth for liquid not picked up by the tow was operated with an identical tow band with the brush member rotated again at 3400 revolutions per minute and the plasticizer booth supplied with plasticizer at the rate to set initial plasticizer additives at a nominal 9%. The band width of the tow band being passed into each applicator device is reduced by altering the air flow to the spreader box, positioned in advance of the applicator chamber. The data generated is as set forth in the following table:

BAND WIDTH CHANGE

| Time (Min) | HAUNI Rod wgt gms/100 rods | INSTANT INVENTION Rod wgt gms/100 rods |
|---|---|---|
| 0 | 73.3 | 81.9 |
| ¼ | 73.5 | 82.2 |
| ½ | 73.7 | 81.9 |
| ¾ | 73.5 | 82.2 |
| 1.0 | 74.0 | 82.0 |
| 1¼ | 73.8 | 82.0 |
| 1½ | 74.0 | 81.9 |
| 1¾ | 73.9 | 82.5 |
| *2 | 73.8 | 82.0 |
| 2¼ | 71.9 | 79.0 |
| 2½ | 71.7 | 79.4 |
| 2¾ | 71.9 | 79.8 |
| 3 | 71.7 | 80.8 |
| 3¼ | 72.0 | 80.9 |
| 3½ | 71.9 | 80.9 |
| 3¾ | | 80.9 |
| 4 | | 81.4 |

*At two minutes, the band width was changed from 10 inches to 7 inches.

Figure 7:
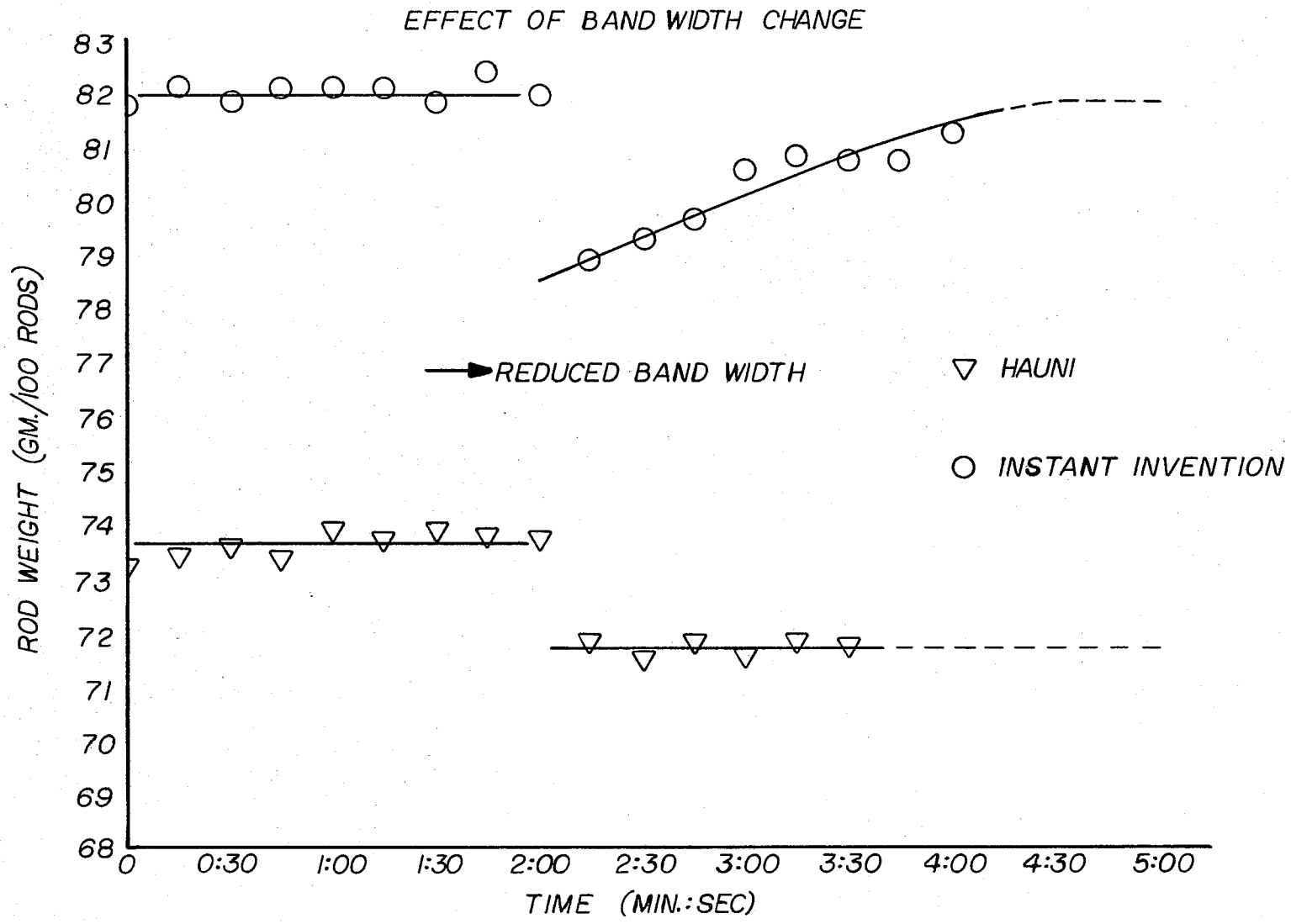
FIG. 7 is a graph illustrating the effect of cigarette tow band width change.

As can be seen from the table and also from the graphic representation set forth in FIG. 7 of the drawings, which plots rod weight against time, with the prior art system, rod weight dropped when tow band width was reduced. However, when the apparatus of the instant invention is employed, rod weights are quickly restored to the preselected weight level.

Having thus disclosed the invention, what is claimed is:

1. A process for controlled application of a liquid to filamentary material comprising, feeding said liquid at a constant rate by means of a first positive displacement pump into the center of a rotatable disc applicator device suitable for applying liquid to a running band of filamentary material, and causing any liquid not picked up by said band of filamentary material to be returned into the center of said applicator device by means of a second positive displacement pump without passage of said returned liquid through said first positive displacement pump.

2. The process of claim 1 wherein a plurality of said discs are employed.

3. The process of claim 1 wherein said disc is essentially shaped in the manner of a narrow mouth cup-like receptacle.

4. The process of claim 1 wherein said band of filamentary material comprises an opened cigarette filter tow, and said liquid is a plasticizer.

5. The process of claim 4 wherein said tow is comprised of continuous cellulose acetate filaments.

6. In the apparatus for applying a liquid material to a tow band, comprising a housing provided at two opposed locations with a pair of openings defining a generally horizontal path therebetween for said tow band, a rotatable disc liquid applicator means located in said housing beneath said tow band, means for adjusting the rate of advance of said tow band past said applicator device and means for adjusting the rate of feed of liquid material to said applicator; the improvement comprising employing a first positive displacement pump to feed liquid at a constant rate into the center of said rotatable disc liquid applicator means and providing said housing with means for draining any liquid not retained by said tow band back to a second positive displacement pump, said second positive displacement pump feeding said nonretained liquid into the center of said disc applicator means without passage of said nonretained liquid through said first positive displacement pump, whereby a change in tow band width does not affect liquid add-on.

7. The apparatus of claim 6 wherein a plurality of said discs are employed.

* * * * *